United States Patent [19]

Grueneberg

[11] 4,323,156

[45] Apr. 6, 1982

[54] BATTERY CONTAINER

[75] Inventor: Bevan E. Grueneberg, Cedarburg, Wis.

[73] Assignee: Pioneer Container Corp., Cedarburg, Wis.

[21] Appl. No.: 273,542

[22] Filed: Jun. 15, 1981

[51] Int. Cl.[3] ..... B65D 73/02; B65D 85/68

[52] U.S. Cl. ..... 206/333; 206/334; 229/37 E; 229/44 R

[58] Field of Search ..... 206/333, 334; 229/37 R, 229/37 E, 44 R

[56] References Cited

U.S. PATENT DOCUMENTS

| | | | |
|---|---|---|---|
| 2,691,480 | 10/1954 | Boeye et al. | 206/333 |
| 2,713,964 | 7/1955 | Repking et al. | 206/333 |
| 2,779,527 | 1/1957 | Fallert | 206/333 |
| 3,189,176 | 6/1965 | Boeye et al. | 206/333 |
| 3,765,527 | 10/1973 | Vargo | 206/333 |
| 3,767,038 | 10/1973 | Channing et al. | 206/333 |

*Primary Examiner*—Joseph Man-Fu Moy
*Attorney, Agent, or Firm*—Wheeler, House, Fuller & Hohenfeldt

[57] ABSTRACT

An open-bottomed storage battery container, made of paperboard material, for protecting components such as the terminals projecting from the top of the battery case from being pressed when batteries in the containers are stacked. The container has four walls and a flap extending from a horizontal score line on each wall. Two opposed flaps have multiple angular score lines to enable folding them into tapered beams that rest on the top of the battery case. The other two opposed flaps serve as container covers. Said other flaps each have an angular score line defining cover and tongue sections. The tongue sections interface at an angle when the covers are closed and their ends rest on top of the battery case to provide support in addition to that provided by the beams.

5 Claims, 7 Drawing Figures

BATTERY CONTAINER

BACKGROUND OF THE INVENTION

This invention pertains to containers for protecting electrical storage batteries against being damaged when several of them are stacked as is the case when they are put on a pallet for being shipped or being stored.

Typically, the terminal posts of a storage battery extend higher above the plane of the top of the battery case than do the terminal interconnecting straps and the filler caps. Hence when batteries are stacked without having suitable spacers between the top of a lower one and the bottom of the next upper one, the terminal posts of the lowest one in the stack would bear the full load of those above it and would likely be deformed or otherwise damaged. With the load being concentrated on the terminal posts rather than distributed over a larger area on top of the case, the internal elements of the battery may be damaged also by force transmitted from the terminal posts.

Many container designs have been proposed for preventing the load from being concentrated on the terminal posts or on the filler caps or terminal straps when batteries in the containers are stacked. U.S. Pat. No. 2,779,527 is one example. It discloses a one-piece corrugated paperboard container which has flaps extending integrally from one pair of opposite side walls. The flaps have parallel score lines which define sections that are folded or bent reentrantly, that is, downwardly and then upwardly to provide a shoulder at the bend which bears on top of the battery case close to its edge to accept the vertical load. The reentrantly bent flap sections interface with each other so the width of the shoulder is equal only to two thicknesses of the paperboard out of which the container is made. The reentrantly bent and interfaced flap sections carry all of the load. The reentrantly folded flaps have a tendency to unfold and can easily do so until another pair of cover flaps are locked with them.

Another prior battery container is disclosed in U.S. Pat. No. 3,056,536. It also uses the reentrantly bent and interfacing flap section concept to define a narrow shoulder that bears on the top of the battery case to accept the load. In this patent, there are cover flaps that are bent horizontally from opposite vertical side walls so they fit tightly between the reentrantly bent flap sections that define the shoulders. This prevents the sections that define the shoulders from unfolding but, again, the cover flaps do not do this until the container is finally closed. As in the case of the previously discussed patent, this patent has the disadvantages of concentrating the load on narrow shoulders, a tendency for the double-folded sections that define the shoulders to open, and the absence of any additional support for the top of the container for distributing some of the load over areas of the battery case top other than its edges.

Another prior art storage battery container is disclosed in U.S. Pat. No. 2,578,107. In this patent, a flap extending from each of an opposite pair of said walls has four parallel score lines which allow the sections of the flap between the score lines to be folded in a closed-loop fashion to define a hollow beam, or cushion as it is called, which bears on the top of the battery case to accept the vertical load. One of the problems perceived in this design is that the reentrantly folded flap sections which form the beam must be perforated so as to enable forming a notch in the sides of the beam for allowing the beam to clear a filler cap or terminal post when the container is placed on a battery. The notch must be quite large so significant weakening of the beam results. Moreover, because of the score lines in the flap for forming the beam being straight or parallel, the beam sections are likely to have a tendency to unfold. In addition, as is illustrated in this patent, the beams or cushions do not bear exclusively on the top of the battery case but could bear on the lead straps that connect the battery cells in series.

SUMMARY OF THE INVENTION

One object of the present invention is to provide a storage battery container that affords maximum protection against the force of a stack of batteries being transmitted to any terminal post, connecting strap, filler cap or any other element projecting from the case of a battery that is below the top of the stack.

Another object is to provide for most of the load due to stacking being carried by a pair of hollow beams which are formed from flaps having angular score lines between sections so that when the sections are folded to form a closed-loop cross-section beam, the beam asssumes a taper from one end to the other to facilitate clearing any obstructions projecting from the top of a battery case. An adjunct to this object is that the angular score lines aid in preventing inadvertent unfolding of the beam.

Another object is to provide a battery container having cover flaps on which there is a section defined by an angular score line and which, when bent downwardly toward the top of the battery case, is disposed diagonally or at an angle across the battery so as to clear the upstanding battery terminals but still make contact with the top of the battery case in areas that are clear of fillers or straps to thereby prevent the cover from being bent in and to distribute a minor portion of the load over areas on the case while the major portion of the load is supported at the edges of the top by the beams.

How the foregoing and other more specific objects of the invention are achieved will be evident in the more detailed description of a preferred embodiment of the invention which will now be set forth in reference to the drawings.

DESCRIPTION OF A PREFERRED EMBODIMENT

Figure 4:
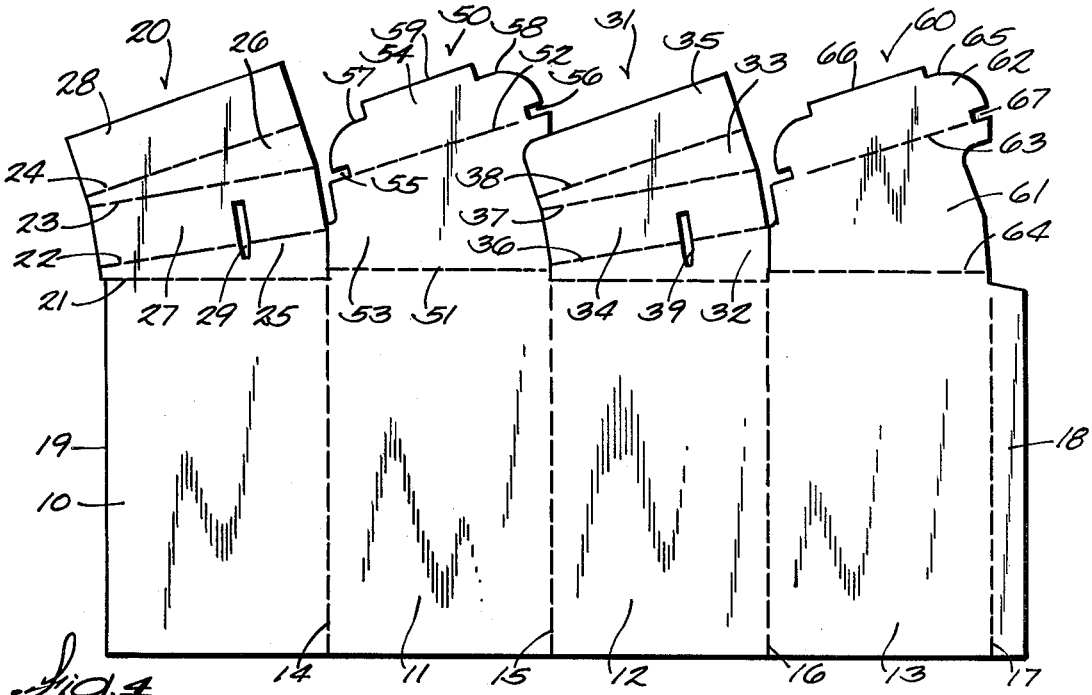
FIG. 4 is a plan view showing the layout of the blank of corrugated paperboard which forms the battery container.

Attention is invited to FIG. 4 for the purpose of identifying the parts of the paperboard blank out of which the new container is formed. The container blank has four panels 10, 11, 12 and 13 separated by vertical score lines 14, 15, 16 and 17. The walls on each side of a score line are folded at a right angle to form a tubular open-bottomed box or container body. Wall panel 13 has a short laterally extending flap 18 that is folded on vertical score line 17 so as to overlap the margin 19 on the far left wall panel 10. Flap 18 is glued to margin 19 for keeping the wall panels in folded condition. For convenience, panels 10 and 12 will be called side walls and panels 11 and 13 will be called end walls.

Side walls 10 and 12 are similar to each other. Considering side wall 10, it has a flap 20 appended to it. This flap begins at a horizontal score line 21. There are three additional score lines 22, 23 and 24 which are at an angle relative to score line 21. The score lines define two basically triangular or tapered sections 25 and 26 and two contiguous rectangular sections 27 and 28. A slot 29 has most of its length in rectangular section 27 but extends partially into triangular section 25.

Figure 3:
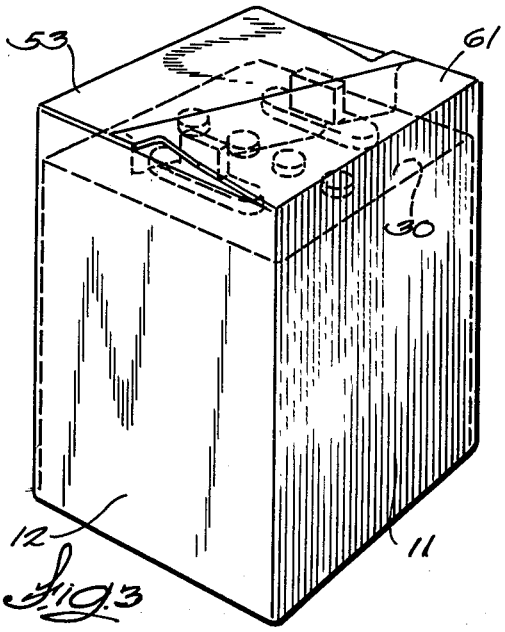
FIG. 3 is a perspective view of the new container installed on a battery.
Figure 1:
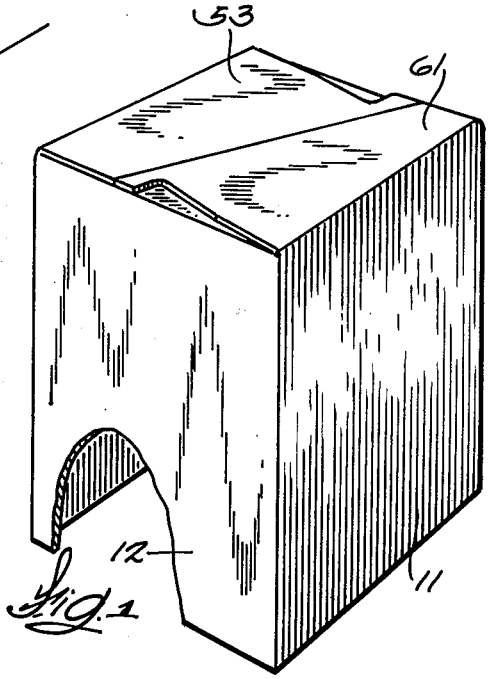
FIG. 1 is a perspective view of an open-bottomed battery container, constructed in accordance with the invention, and positioned for being slipped over a battery.
Figure 6:
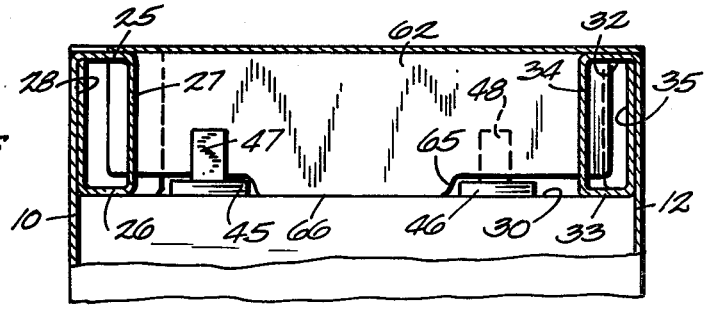
FIG. 6 is a partial vertical section taken on a line corresponding with 6—6 in FIG. 5.

Flap 20 is folded reentrantly on its score lines to form a closed-loop cross section or hollow tapered beam that will ultimately bear upon the top of the battery case, said case top being identified by the numeral 30 in FIG. 1. FIG. 6 shows most clearly how, after folding, triangular section 25 becomes horizontally disposed and serves as the top of the tapered beam. Rectangular section 27 becomes disposed vertically and is spaced away from wall panel 10 by the width of the triangular section. Triangular section 26 becomes disposed under triangular section 25 and the two triangular sections are congruent. Rectangular section 28, when folded, stands upwardly and interfaces with the face of side wall 10 that is opposite to the face which is viewed in FIG. 4.

Referring again to FIG. 4, side wall 12 of the container which will face side wall 10 when the container is folded is also provided with a flap 31 that has the same basic characteristics as flap 20 on side wall 10. Flap 31 is comprised of triangular sections 32 and 33 with contiguous rectangular sections 34 and 35 defined by angulated score lines 36, 37 and 38. Flap 31 is folded in the manner described in connection with flap 20 to form a tapered hollow beam which rests on the battery case top 30 when the container is deposited on the battery.

Figure 2:
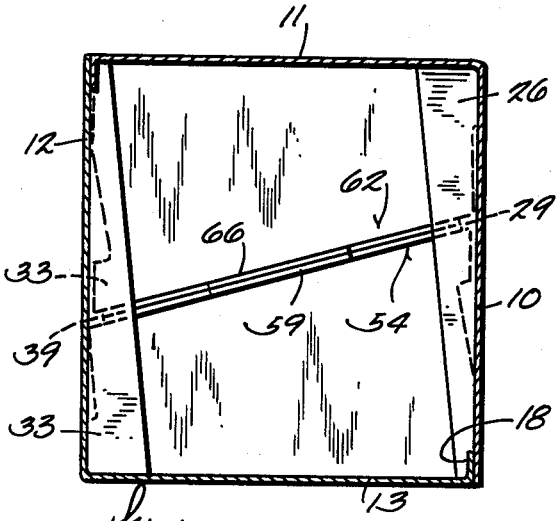
FIG. 2 shows the top inside of the container as viewed through its open bottom.

FIG. 2, which is a view looking through the open bottom of the container towards its top, shows how the tapered beams are developed next to side walls 10 and 12 at the top of the container. The triangular sections which are on the bottom of the hollow beam are marked 26 and 33 as they are in FIG. 4. As previously mentioned, FIG. 6 shows the cross sections of the two beams. The triangular sections can also be seen in top view in FIG. 5. Note in FIGS. 5 and 6 how the tapered beams clear the lead cell-interconnecting straps 45 and 46 and the upstanding battery terminal posts 47 and 48.

Referring again to FIG. 4, one may see that end wall 11 has a cover flap 50 contiguous with it along a horizontal score line 51. There is another score line 52 which is angulated and which, with score line 51, defines a flat section 53 that is part of the cover for the container. Section 53 is folded on score line 51 and assumes a horizontal position when the cover is closed. Cover flap 50 also has a tongue section 54 that folds on angular score line 52 and is vertically disposed when the cover is closed on the container. Tongue 54 has notches 55 and 56 which are for locking the cover in a closed position by engaging with the slot 29 and 39 in the beam. Tongue section 54 has offsets or set back edges 57 and 58 which result in a projection being formed the end of which is straight and marked 59.

End wall 13 has a cover flap 60 which is generally comparable to cover flap 50. It has a flat section 61 separated from a tongue section 62 by an angular score line 63. Flap 60 is contiguous with wall panel 30 at a score line marked 64. Section 62 has an offset edge 65 and a counterpart which result in a projection being formed whose straight edge is marked 66. Cover flap 60 also has notches such as the one marked 67 for locking the cover in closed condition.

Figure 7:
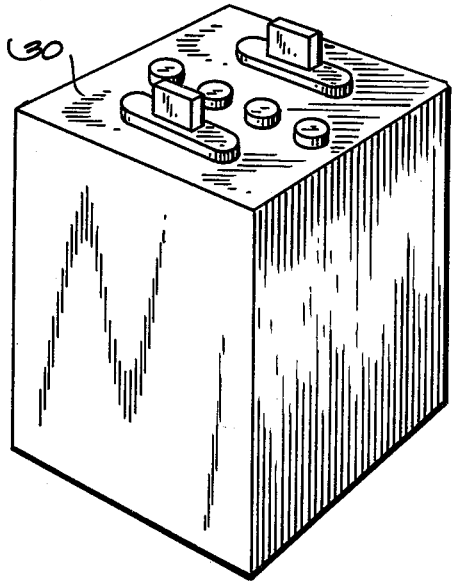
FIG. 7 is a partial vertical section taken on a line corresponding with 7—7 in FIG. 5.
Figure 7:
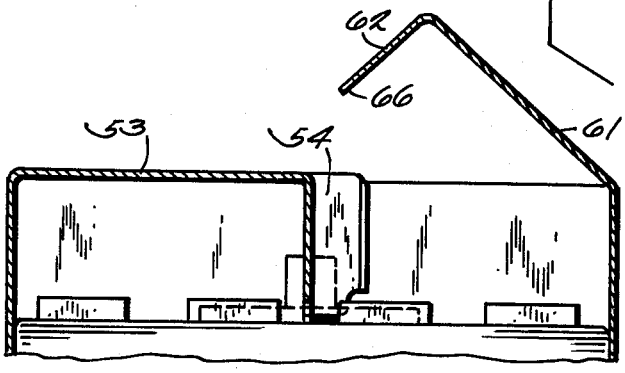
Figure 5:
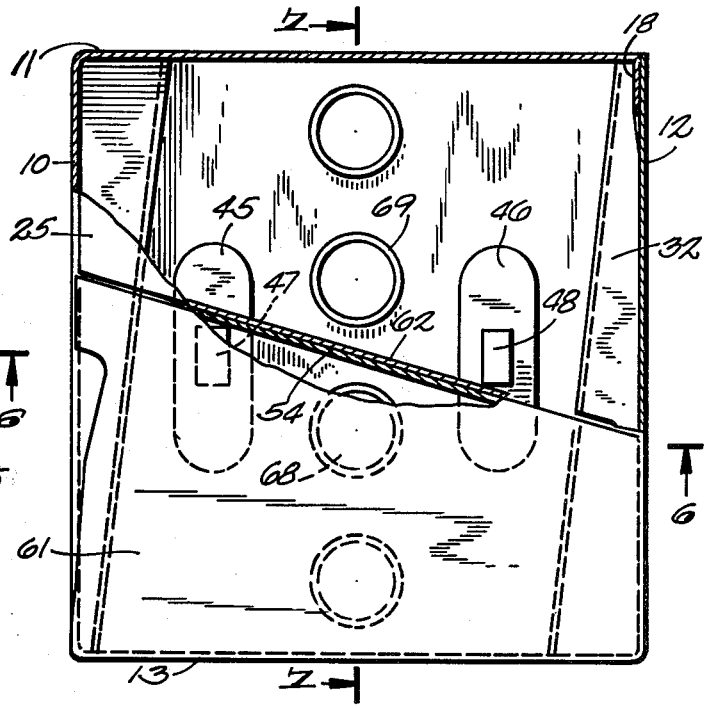
FIG. 5 is a plan view of the container installed on a battery with part of the top being broken away to show the interior thereof.

FIGS. 5 and 6 show the covers in closed condition. Note in FIG. 6 that the typical tongue 62 then extends vertically and the end or edge 66 of the projection on the tongue bears on the flat top 30 of the battery case to thereby provide further support for the cover of the container and, hence, it shares some of the load that is imposed on one container by having others with batteries in them stacked on it. The offset 65 allows the lower edge of the vertical cover flap 62 to clear the top of connector strap 46. As shown in FIG. 5, the diagonal or angulated disposition of the vertically extending tongues 62 and 54 permits the tongues to clear the upstanding battery terminal posts 47 and 48. Thus, it is evident that the top of the container is not only supported on the triangular or tapered beams at the outside edges but there is a cross support resulting from the tongues of the cover flaps, that is, the edges 59 and 66 of the extensions bearing on the top surface 30 of the battery. In FIG. 7, one of the cover flaps is folded in its home position wherein angulated tongue 54 is in its full vertical position and tongue 62 is in a position for being pushed down to interfacing relationship with tongue 54. Note in FIGS. 5–7, that when the tongues are vertical they not only clear upstanding battery terminal posts 47 and 48 but they also pass with clearance between filler caps such as those marked 68 and 59.

When the tapered beams are folded and in place as in FIGS. 2 and 5, for example, the slots 29 and 39 in the beams (see FIG. 4) are vertically disposed in downwardly extending rectangular sections 27 and 34 and one end of each slot is present in horizontally extending triangular sections 25 and 32, respectively. The side edges of the tongues 62 and 54 drop into these slots in the beams, as is illustrated best in FIG. 2, and the notches such as notch 56 on cover flap 50 and notch 67 on cover flap 60 interlock with the slots to prevent the covers from opening.

In summary, a new battery container has been described which is characterized by having angularly scored flaps for forming hollow tapered beams that are especially strong for resisting the vertically applied loads and for resisting inadvertent unfolding. The beams are imperforate except for small slots with which the covers engage to lock them. Support across the battery top without imposing any load on the battery terminals or filler caps is obtained by angularly scored cover flaps that produce tongues which are angulated and interfaced when the cover flaps are closed.

Although a preferred embodiment of the new battery container has been described in detail, it will be understood that minor modifications can be made in the realm of the basic concepts of the new container design. Accordingly, the scope of the invention is to be determined only by construing the claims which follow.

I claim:

1. A storage battery container formed of paper material and comprising:

integral pairs of side walls and end walls that form the body of the container, the side walls each having an integral flap extending from a horizontal score line that determines the top edge of the wall, said flaps each having other score lines that are at an angle relative to the horizontal score line to thereby define a first triangular section, a first rectangular section, a second triangular section and a second rectangular section, said sections being foldable on the score lines to dispose the first triangular section horizontally, the first rectangular section vertically, the second triangular section horizontally and congruent to the first triangular section, and the second rectangular section vertically and at an angle relative to the first rectangular section to thereby form tapered hollow beams for bearing on opposite sides of the top of a battery case to prevent a load imposed on the battery from being transmitted to components of the battery which extend above its top.

2. The container according to claim 1 wherein:

said end walls each have an integral flap extending from a horizontal score line that determines the top edge of the end wall, said flaps each having a score line disposed at an angle relative to said horizontal score line to define a cover section extending from one side of the angled score line to the horizontal score line and a tongue section extending from the other side of the other side, folding said cover sections on the horizontal score lines to a horizontal position and folding said tongue sections to a vertical position on said angled score lines causing said tongue sections to interface with each other at a corresponding angle and the said end of tongue section to contact the top of a battery case.

3. The container according to claim 2 wherein said end of the tongue section is a projection defined by set back end edges thereof, the set back edges permitting the tongue section to clear components of the battery extending above its case while permitting said projection to bear on the top of the case.

4. The container according to any of claims 2 or 3 wherein said vertical first rectangular sections comprising the beams have a slot into which the tongue sections of the cover register when said cover is closed, the slots having a width about equal to combined thickness of the tongue sections.

5. A storage battery container formed of paper material and comprising:

integral pairs of side walls and end walls that form the body of the container, the side walls each having an integral flap extending from a horizontal score line that determines the top edge of the wall, said flaps each having other score lines that are at an angle relative to the horizontal score line to thereby define a first triangular section, a first rectangular section, a second triangular section and a second rectangular section, said sections being foldable on the score lines to dispose the first triangular section horizontally, the first rectangular section vertically, the second triangular section horizontally and congruent to the first triangular section, and the second rectangular section vertically and at an angle relative to the first rectangular section to thereby form tapered hollow beams for bearing on opposite sides of the top of a battery case to prevent a load imposed on the battery from being transmitted to components of the battery which extend above its top, said end walls each have an integral flap extending from a horizontal score line that determines the top edge of the end wall, said flaps each having a score line disposed at an angle relative to said horizontal score line to define a cover section extending from one side of the angled score line to the horizontal score line and a tongue section extending from the other side of the other side, folding said cover sections on the horizontal score lines to a horizontal position and folding said tongue sections to a vertical position on said angled score lines causing said tongue sections to interface with each other at a corresponding angle and the said end of tongue section to contact the top of a battery case.

* * * * *